US005339753A

United States Patent [19]

Martin et al.

[11] Patent Number: 5,339,753

[45] Date of Patent: Aug. 23, 1994

[54] SECONDARY AIR NOZZLE FOR FURNACES

[75] Inventors: Walter J. Martin, Tegernsee; Johannes J. E. Martin, Munich, both of Fed. Rep. of Germany

[73] Assignee: Martin GmbH fuer Umweltund Energietechnik, Munich, Fed. Rep. of Germany

[21] Appl. No.: 126,930

[22] Filed: Sep. 27, 1993

[30] Foreign Application Priority Data

Sep. 28, 1992 [DE] Fed. Rep. of Germany ..... 4232488

[51] Int. Cl.[5] ..... F23L 13/00

[52] U.S. Cl. ..... 110/313; 110/297; 110/348; 239/288.5; 239/DIG. 19

[58] Field of Search ..... 239/104, DIG. 19, 591, 239/288, 288.3, 288.5; 110/309, 313, 348, 314, 297

[56] References Cited

U.S. PATENT DOCUMENTS 2,268,279 12/1941 Debemham et al. ..... 239/DIG. 19

5,174,226 12/1992 Martin et al. ..... 110/297

FOREIGN PATENT DOCUMENTS 0153613 7/1987 Japan ..... 234/DIG. 19

*Primary Examiner*—Edward G. Favors

*Attorney, Agent, or Firm*—McAulay Fisher Nissen Goldberg & Kiel

[57] ABSTRACT

The secondary air nozzle for furnaces has a curved base body which is provided with pins for holding a ceramic protective casing. A protective strip which projects radially from the base body is arranged along the longest line of curvature proceeding from the nozzle opening until beyond the curved part, its radial dimension corresponding at least to the thickness of the ceramic protective casing. The protective strip is constructed as a rib which projects radially from the base body and is outfitted with pins for supporting the ceramic body.

6 Claims, 6 Drawing Sheets

SECONDARY AIR NOZZLE FOR FURNACES

BACKGROUND OF THE INVENTION a) Find of the Invention

The invention is directed to a secondary air nozzle for furnaces with a curved base body provided with pins for holding a ceramic protective casing.

b) Background Art

It is known to arrange curved secondary air nozzles in the cover of the furnace body above the front edge of the feed table. These secondary air nozzles emerge vertically from the furnace body cover and are aligned at an inclination of roughly 75° toward the furnace body. Because a high concentration of low temperature carbonization gases are encountered in this region, secondary air is introduced in this region to enable combustion of these gases. Since these low-temperature carbonization gases are very aggressive, secondary air nozzles made of metal are subject to intensive corrosion. In order to protect these nozzles against corrosion it is known to provide a protective casing of ceramic material. A plurality of radially projecting pins are welded on the outer casing of the secondary air nozzle so as to hold the ceramic body at the outer casing of the secondary air nozzle. This provides a largely satisfactory protection against corrosion, but the useful life of such secondary air nozzles is nevertheless limited because the feeding of fuel, particularly refuse, causes banked-up masses of fuel to be pushed past the nozzle so that the ceramic casing is destroyed by mechanical action, which results in accelerated corrosion of the secondary air nozzle. The pins for holding the ceramic bodies are exposed as a result of mechanical damage and corrode first at an accelerated rate so as to undermine the support of the ceramic bodies, thus accelerating the mechanical destruction of the protective casing with ensuing corrosion of the secondary air nozzle.

OBJECT AND SUMMARY OF THE INVENTION

The primary object of the present invention is to increase the protective action against corrosion and mechanical destruction in a simple construction of the secondary air nozzle.

This object is met, according to the invention, in a secondary air nozzle of the type mentioned above in that a protective strip which projects radially from the base body is arranged along the longest line of curvature proceeding from the nozzle opening until beyond the curved part, its radial dimension corresponding at least to the thickness of the ceramic protective casing. The arrangement of this protective strip, which extends at least so as to be flush with the ceramic protective casing or even projects beyond the latter, protects the ceramic protective casing from mechanical destruction due to portions of fuel, Particularly pieces of refuse, which are pushed past it.

In its simplest design, the protective strip can be constructed as a flat, radially projecting rib.

In a further development of the invention, the protective strip advisably has pins projecting at right angles from the rib in order to provide a secure adhesion or composite action between the protective strip and ceramic protective casing.

In a preferred construction, the protective strip is T-shaped with a radially projecting crossbar. Thus not only is the protective surface coming into contact with the pieces of fuel increased as a result of the crossbar, but an improved anchoring of the ceramic protective casing is also achieved in this region, since the ceramic protective body formed behind the crossbar is held by it.

In a further development of the invention, the pins arranged at the base body are disposed in horizontally extending planes proceeding from the installed position of the secondary air nozzle. This not only results in a particularly good holding action in relation to the ceramic protective casing, but also provides the precondition for a further advantageous construction in which the pins and the protective strip are produced by casting so as to form one piece with the base body. Manufacturing the secondary air nozzle by means of casting substantially reduces the costs of producing such a secondary air nozzle compared to the previous construction in which the pins were welded on individually. Another considerable advantage resulting from casting consists in a homogeneous connection between the pins and the base body on the one hand and between the protective strip and the base body on the other hand, so that these parts are subjected to an improved cooling action by the air blown out of the secondary air nozzle. In previously known nozzles, such a connection existing only by way of the weld seam, while the individual pin contacted the base body detachably so that the heat conduction, if any, between the base body and the pin was insufficient. Accordingly, insofar as they were exposed by mechanical destruction of the ceramic protective casing, these pins were subjected to a particularly intensive heating action which increased the rate of corrosion of these pins.

BRIEF DESCRIPTION OF THE DRAWINGS

In the following, the invention is described in greater detail with reference to embodiment examples.

DESCRIPTION OF THE PREFERRED EMBODIMENT

Figure 1:
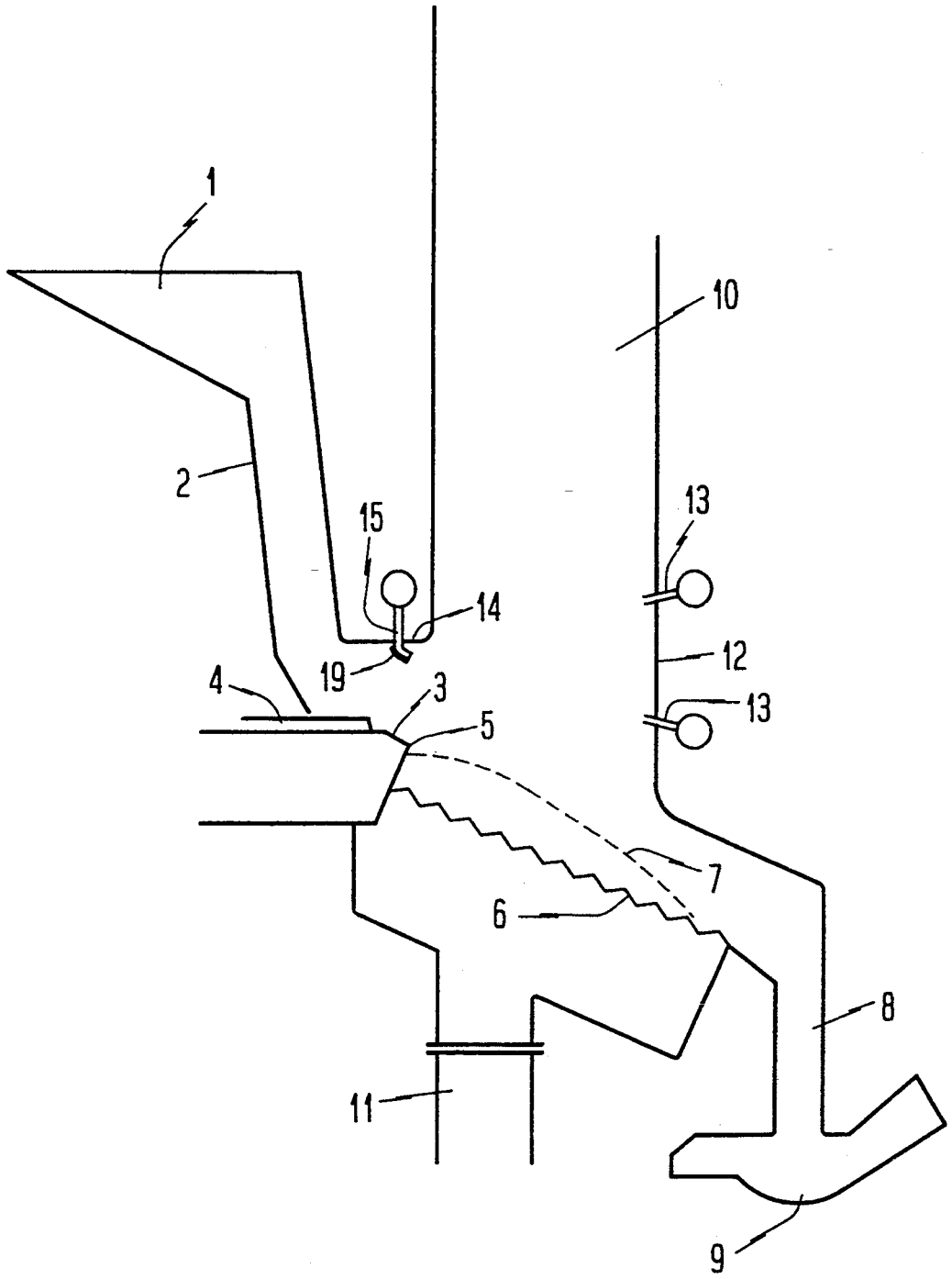
FIG. 1 shows a schematic view of a furnace installation provided with secondary air nozzles.

The highly schematic view in FIG. 1 was chosen to show the location at which a secondary air nozzle according to the invention is arranged. This figure shows a furnace installation with a feed hopper 1 and a feed chute 2 through which the fuel, preferably refuse, falls on a feed table 3 on which charging pistons 4 push the refuse over the charging edge 5 of the feed table 3 onto a furnace grate 6. The combustible matter, designated by 7, lying on the furnace grate 6 is slowly transported to a slag or ash drop chute 8, where the spent ashes fall into a de-slagger or ash discharger 9. The combustible gases rising from the furnace grate enter an ascending furnace body 10, the main mass of the combustion air being fed to the furnace grate 6 from below through a line 11.

In the furnace installation shown in the drawing, two secondary air nozzles 13 are provided in the rear wall 12, whereas one secondary air nozzle 15 is provided in the wall 14 opposite the charging edge 5. The secondary air nozzles are supplied with air through pipelines. The secondary air nozzle 15 is curved and serves to feed combustion air into the region located approximately over the charging edge 5 of the feed table 3. A particularly strong concentration of aggressive low temperature carbonization gases are encountered in this region.

The secondary air nozzle is curved in such a way that it blows into the furnace body 10 in the direction of the fuel flow.

Figure 2:
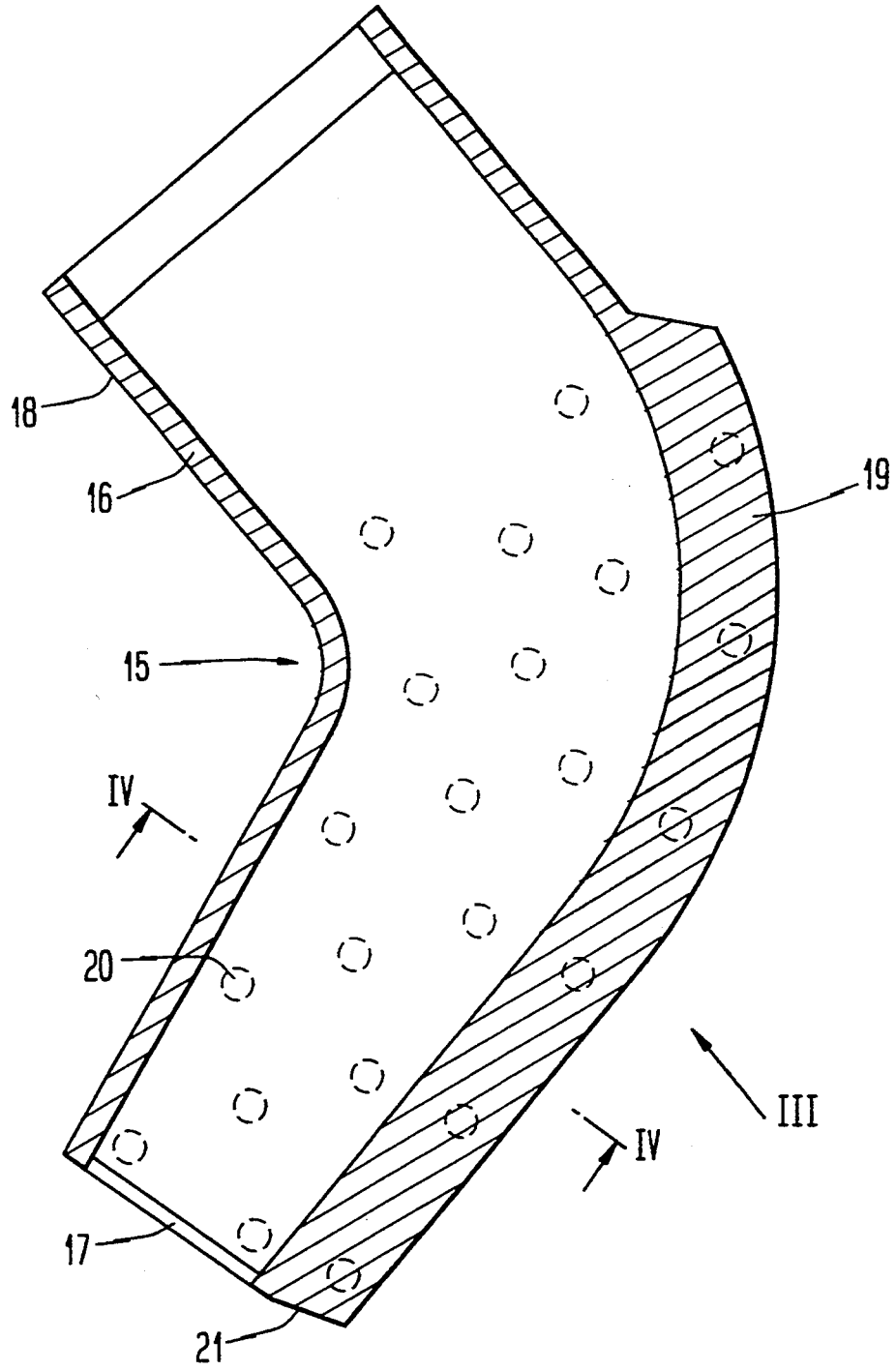
FIG. 2 shows a longitudinal section through a secondary air nozzle.
Figure 3:
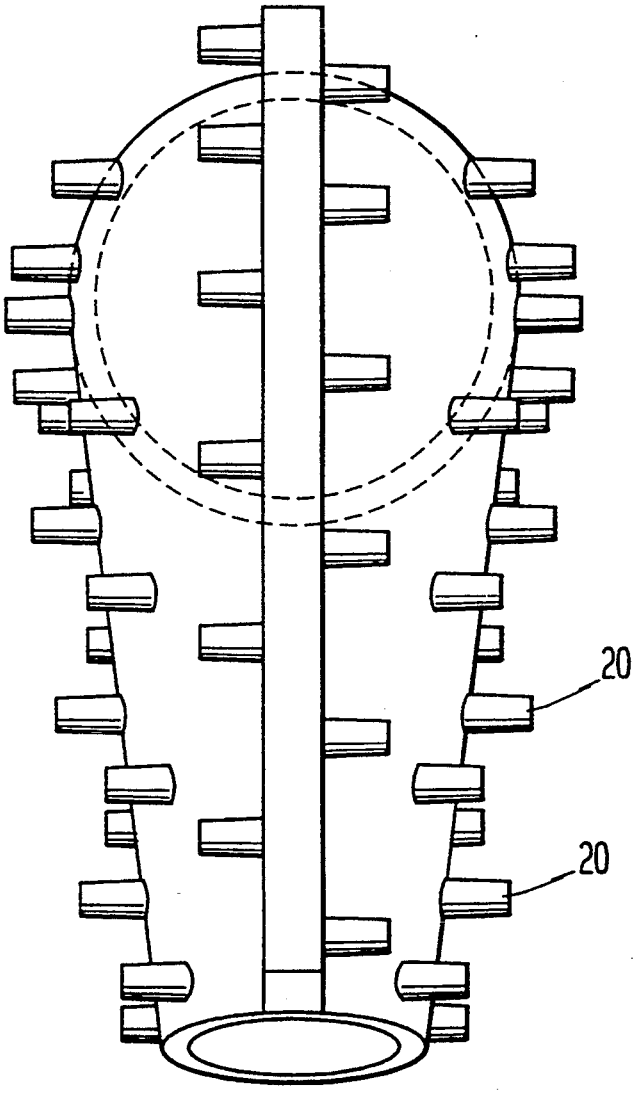
FIG. 3 shows a view in the direction of arrow III in FIG. 2.
Figure 4:
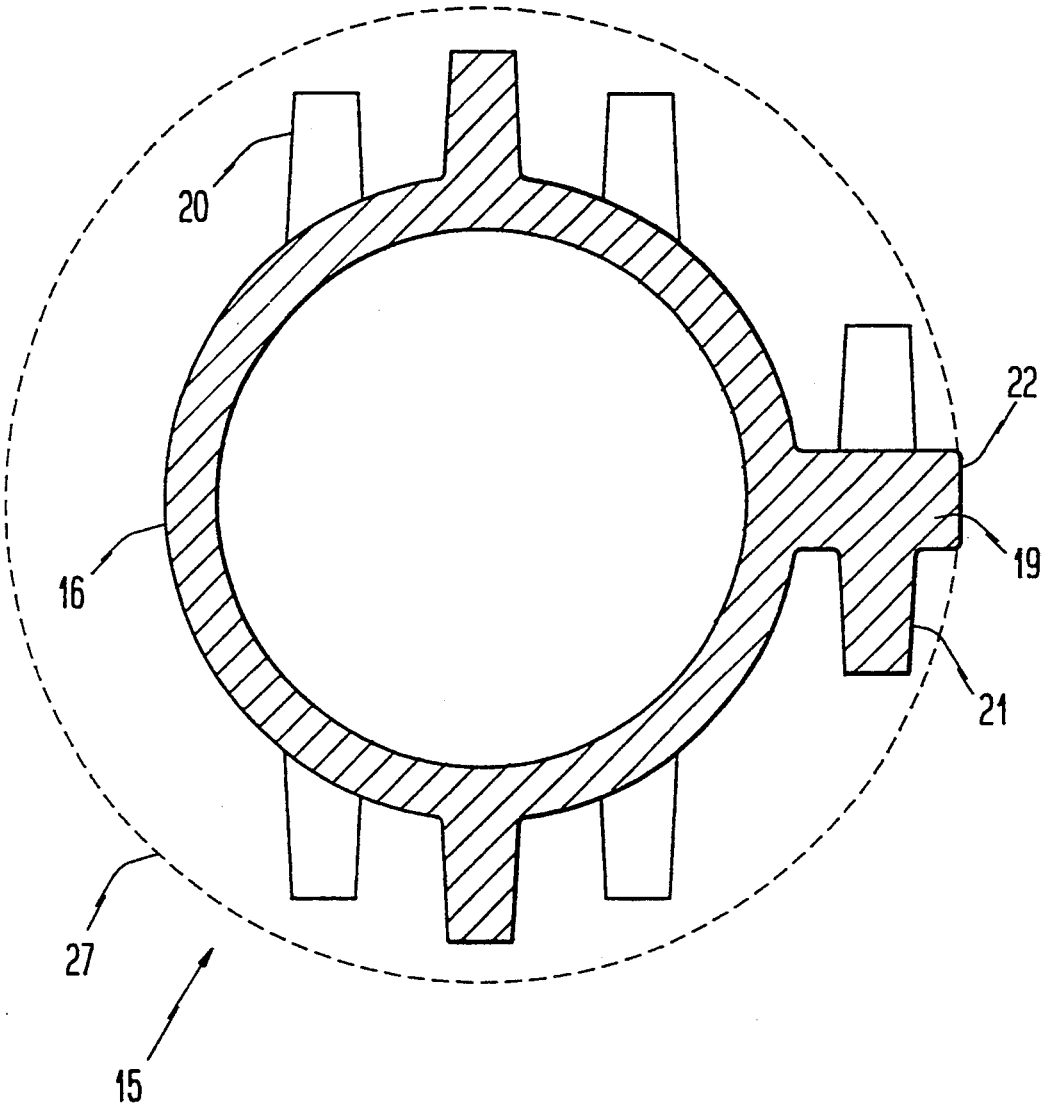
FIG. 4 shows a section according to line IV—IV in FIG. 2.
Figure 5:
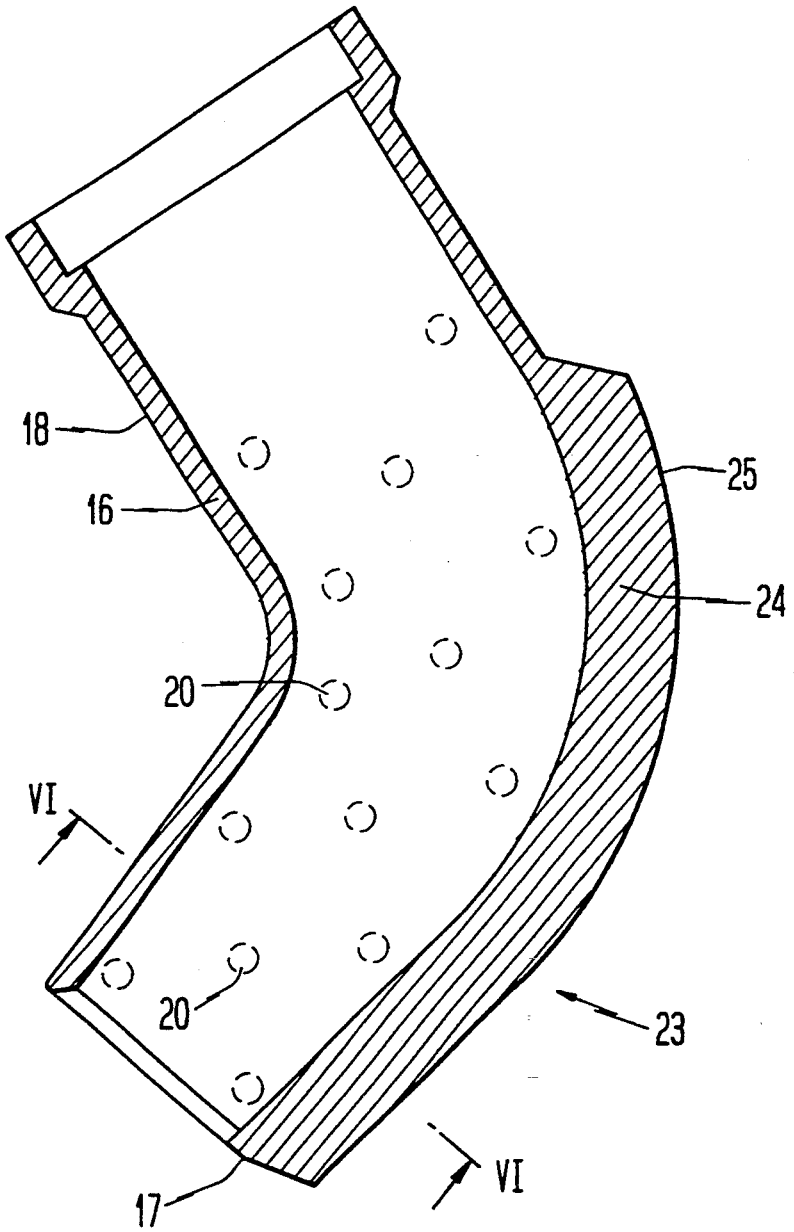
FIG. 5 shows a side view of a modified embodiment form.
Figure 6:
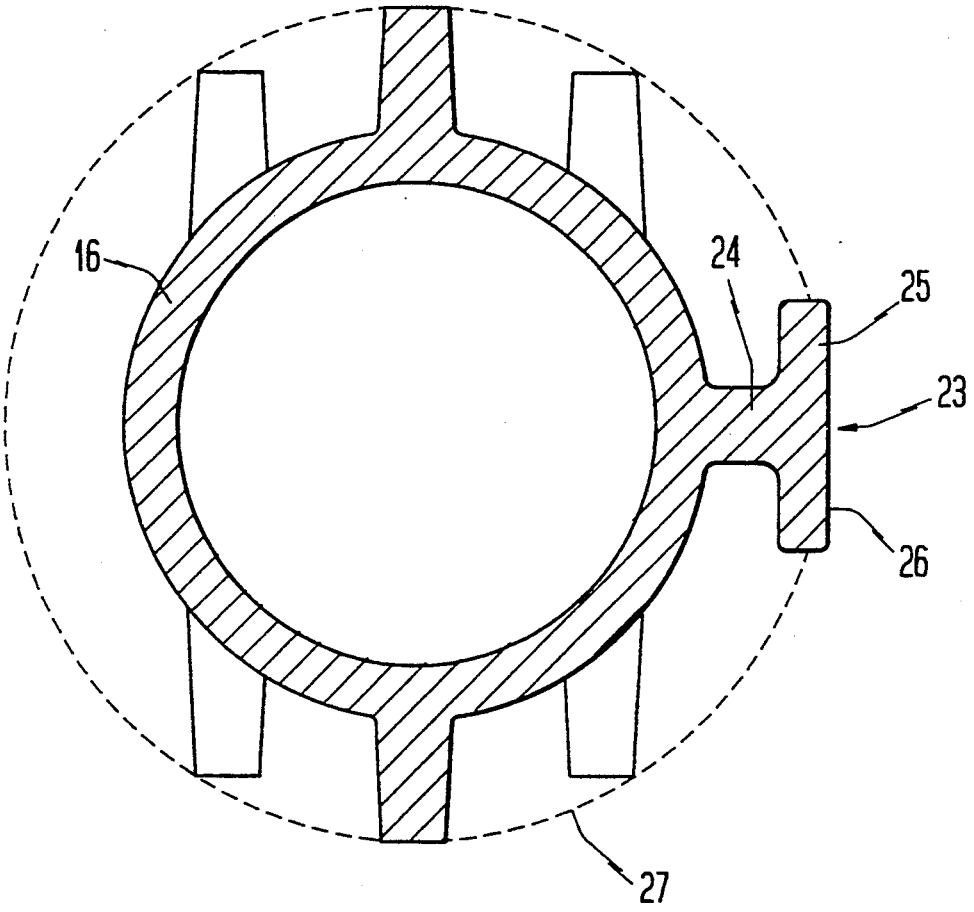
FIG. 6 shows a section according to line VI—VI in FIG. 5.

FIGS. 2 to 4 show a first embodiment form of a secondary air nozzle, while FIGS. 5 and 6 show a second construction of such a secondary air nozzle which is designated by 15 in FIG. 1.

As can be seen from FIGS. 2 to 4, the secondary air nozzle 15 has a base body 16 which narrows in diameter toward the nozzle opening 17 and is curved, preferably at an angle of 75°, proceeding from a short connection piece 18. A protective strip 19 is formed on so as to be integral with the base body 16 along the longest line of curvature. This protective strip 19 is located at the underside of the secondary air nozzle in the installed state. As can be seen from FIG. 3 in conjunction with FIG. 4, pins 20 are constructed at both sides of the base body 16 so as to be integral with the base body 16 and lie in horizontal planes in the installed state of the nozzle. Additional pins 21 which likewise lie in horizontal planes in the installed state of the nozzle are constructed at the protective strip 19 so as to form one piece with it. The base body 16, the protective strip 19, and the pins 20 and 21 are produced by casting so as to form one piece in their entirety.

The pins 20 and 21 serve to hold a ceramic protective casing 27 surrounding the base body 16. The ceramic protective casing 27 encloses the base body on all sides, its thickness being so selected that the outer surface 22 of the protective strip 19 closes flush with the ceramic protective casing. Since the protective strip 19 projects down into the furnace body in the installed state of the secondary air nozzle 15, it can protect the ceramic protective casing 27 against mechanical damage caused by refuse which is pushed past it.

In the embodiment form according to FIGS. 5 and 6, the base body 16 and the integrally cast pins 20 are constructed in the same manner as in the construction according to FIGS. 2 to 4. The only difference consists in the construction of the protective strip which is T-shaped in this embodiment form, as can be seen particularly in FIG. 6, and is designated by 23 in its entirety. The web projecting away from the base body 16 radially is designated by 24 and the crossbar extending at right angles to the latter and projecting over the web 24 on both sides is designated by 25. The ceramic body formed around the base body 16 is held by the pins 20 and the crossbar 25 of the protective strip 23. The ceramic protective casing 27 is shaped in such a way that at least the outer surface 26 of the crossbar 25 is exposed and protects the ceramic protective casing against wear resulting from hard parts which are pushed past it. This large surface area of the protective strip 23 is made possible in spite of the intensive heating action in that it is produced in one piece with the base body and accordingly has a good heat conducting connection with the base body into which cool combustion air flows so that the protective strip 23 does not take on excessively high temperatures in spite of the intensive heat radiated by the crossbar 25. The protective effect due to the crossbar 25 is greater than that of the protective strip 19 which is relatively narrow. Moreover, the crossbar 25 provides a particularly good support for the ceramic protective casing 27 which is formed on the base body 16 and is indicated by dashed lines.

While the foregoing description and drawings represent the preferred embodiments of the present invention, it will be obvious to those skilled in the art that various changes and modifications may be made therein without departing from the true spirit and scope of the present invention.

What is claimed is:

1. A secondary air nozzle for furnaces comprising:

a curved base body which is provided with pins for holding a ceramic protective casing; and a protective strip projecting radially from said base body and being arranged along the longest line of curvature proceeding from an opening of said nozzle until beyond the curved part of said base body; said base body having a radial dimension corresponding at least to the thickness of the ceramic protective casing.

2. The secondary air nozzle according to claim 1, wherein said protective strip is constructed as a flat radially projecting rib.

3. The secondary air nozzle according to claim 2, wherein said protective strip has pins which project away from the rib at right angles thereto.

4. The secondary air nozzle according to claim 1, wherein said protective strip is T-shaped with radially projecting crossbar.

5. The secondary air nozzle according to claim 1 wherein said pins arranged at said base body are disposed in horizontally extending planes proceeding from the installed position of the secondary air nozzle.

6. The secondary air nozzle according to claim 1 wherein said pins and said protective strip are produced in one piece with said base body by casting.

* * * * *